US007388515B2

(12) United States Patent
Hill

(10) Patent No.: US 7,388,515 B2
(45) Date of Patent: Jun. 17, 2008

(54) REVERSIBLE HIGHWAY SIGN WARNING LIGHTS

(76) Inventor: Joe Shane Hill, 10363 Faust Rd., Lebanon, IL (US) 62254-2805

( * ) Notice: Subject to any disclaimer, the term of this patent is extended or adjusted under 35 U.S.C. 154(b) by 423 days.

(21) Appl. No.: 11/105,724

(22) Filed: Apr. 15, 2005

(65) Prior Publication Data

US 2006/0232441 A1 Oct. 19, 2006

(51) Int. Cl.
*G08G 1/095* (2006.01)

(52) U.S. Cl. ..... 340/908; 340/908.1; 40/586

(58) Field of Classification Search ..... 340/907, 340/908, 908.1; 116/63 P, 63 R; 40/586, 40/610

See application file for complete search history.

(56) References Cited

U.S. PATENT DOCUMENTS 5,422,638 A * 6/1995 Singer et al. ..... 340/908.1
5,598,654 A * 2/1997 Cowgill et al. ..... 40/610
5,755,051 A 5/1998 Zumbuhl
6,104,313 A * 8/2000 Boyd, II ..... 340/908.1
7,075,427 B1 * 7/2006 Pace et al. ..... 340/539.22

* cited by examiner

*Primary Examiner*—Van T. Trieu
(74) *Attorney, Agent, or Firm*—Don W. Weber

(57) ABSTRACT

After-market, detachable warning lights for a reversible highway sign are easily attachable to existing stop/slow highway signs currently in use in highway construction areas. Left and right light boxes are attached to opposite vertical edges of the sign with a pair of red lights on the "stop" side of the sign and a pair of yellow lights on the "slow" side of the sign. A multi-functional switch enables the workman to create a variety of lighting conditions. These conditions could include red and yellow constantly ON; red and yellow blinking; red and yellow strobing slowly; and red and yellow strobing rapidly. In addition, the switch enables the workman to put either set of lights in a particular independent mode thus increasing the variation of the lighting system. For example, the red lights may utilize a constant ON mode while the yellow lights could be slowly strobing. The sign and pole have internal wiring and are supported by a lower base with wheels. The twelve-volt battery supply rides on the base. The sign is readily moved from site to site and allows the workman to select many different combinations of lighting effects.

5 Claims, 2 Drawing Sheets

REVERSIBLE HIGHWAY SIGN WARNING LIGHTS

BACKGROUND OF THE INVENTION

This invention relates to the field of highway maintenance and safety. More particularly, a reversible highway worker warning sign apparatus is disclosed which is used to protect highway workers in construction areas.

During road construction, highway workers are often placed in a dangerous position. Because most road construction occurs while traffic is still moving, cars move past the construction site, often at a fast speed. Highway workers are subject to the oncoming traffic and must perform their construction duties simultaneously with keeping a careful watch out for oncoming traffic. Because the highway worker is often distracted from safety precautions due to their attention to their construction jobs, highway departments have instituted various types of safety measures.

In particularly dangerous situations, a worker carrying a highway safety sign guards construction crews, usually having one sign at each end of the construction zone. When lanes are blocked off, these cautionary highway signs and flagmen also direct traffic such that vehicles may use only one lane of the roadway for both directions of traffic. In order to accomplish this, one flagman will stand at the beginning of the construction site with a dual stop/slow warning sign. A second flagman stands at the other end of the construction site with a similar stop/slow highway sign. As traffic is directed through the construction site, one worker will display the "slow" side of the sign to oncoming traffic while another worker, at the opposite end of the traffic pattern, will display the "stop" side of the sign. This allows traffic to move slowly past the construction site in one direction. Once the line of traffic has moved past the construction site, the workers will then reverse their signs so that the traffic can move in the other direction.

The double-sided signs in these highway construction sites often serve the purpose of adequately protecting the highway workers, particularly in daylight. However, under particularly hazardous conditions such as highway construction on an interstate highway where speeds are often in excess of 70 miles per hour, further safety measures are necessary. One particular type of safety measure that improves the safety of the construction sight is the attachment of warning signals or other lighted devices to the stop/slow highway sign.

One such highway warning sign device is found in the 1998 patent issued to Zumbuhl, U.S. Pat. No. 5,755,051. Zumbuhl disclosed a special type of bracket assembly to support a sign. The sign itself is inserted into the bracket assembly. Zumbuhl also has warning lights attached on the top and bottom of the bracket. The stop and slow signs are illuminated with the addition of the upper and lower lights. However, there are other means which would increase the recognition of the hazard sign and that can be attached to already existing traffic hazard signs.

It is an object of this invention to provide a visually lighted traffic hazard sign that may be readily attached to signs that already exist and are already in use throughout the United States. A particular advantage of supplying a lighting system that can be attached to the already existing signs is the decrease in cost associated with completing the entire system, since new signs would not have to be made or signs would not have to be fitted to the other brackets.

It is another object of this invention to provide a lighting system for a traffic hazard sign that is itself reversible. One side of the lights would show red, to signify the side of the sign with the "stop" emblem. The lights on the opposite or "slow" side of the sign would show yellow.

It is a still further object of this invention to provide a set of red and yellow lights that could alternately flash, strobe slowly, or strobe quickly. Other and further objects of this invention will become obvious upon reading the below described specification.

BRIEF DESCRIPTION OF THE INVENTION

An after market, reversible lighting device is attached to existing stop/slow highway safety warning signs and a two or four-wheeled dolly. Two light boxes house left and right red and left and right yellow warning lights. The boxes are attached to opposite vertical sides of the sign by brackets. The red lights positioned on one side of the pair of boxes are attached such that they are displayed on the "stop" side of the hazard warning sign. The yellow lights are attached on the "slow" side of the sign. The lights are provided with a DC power light source as well as a bottom base carriage to support both the sign and the light source. A switch allows the workmen to either turn on the red lights, yellow lights, or both lights. The switch also allows the workmen to flash, strobe slowly, or strobe rapidly either the red lights, yellow lights, or both lights simultaneously. The twelve-volt power source is rechargeable through AC current. A solar charging source is also provided.

BRIEF DESCRIPTION OF THE DRAWING FIGURES

DETAILED DESCRIPTION OF THE PREFERED EMBODIMENT

A reversible highway traffic sign has a stop sign 1 on one side. On the opposite side of the sign, not shown, is a standard warning slow sign that has a standard warning size triangular shape displayed thereon. The lettering on the stop side of the sign is "STOP". The lettering on the slow side of the sign is "SLOW".

Figure 2:
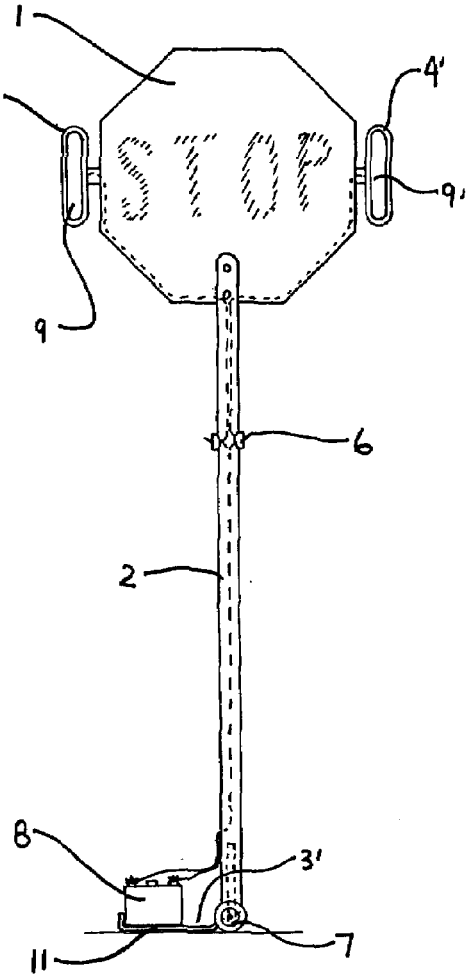
FIG. 2 is a front view of the dolly embodiment of the reversible sign.

A longitudinal vertical handle 2 supports sign 1 and is in turn supported by a box like base 3. The handle 2 supports the upper lettered sign portion 1 of the reversible highway traffic sign. The handle 2 is hollow and may be conveniently made of PVC pipe or a similar material. The wiring for the sign is contained inside the hollow handle 1 for safety reasons to eliminate loose wires from hanging on the outside of the device. The base 3 may alternatively be a two-wheeled dolly 3', similar to hand truck dollies in common use. The two-wheeled version of the device, shown in FIG. 2, has a lower horizontal platform 11 for carrying the battery and power system.

Figure 1:
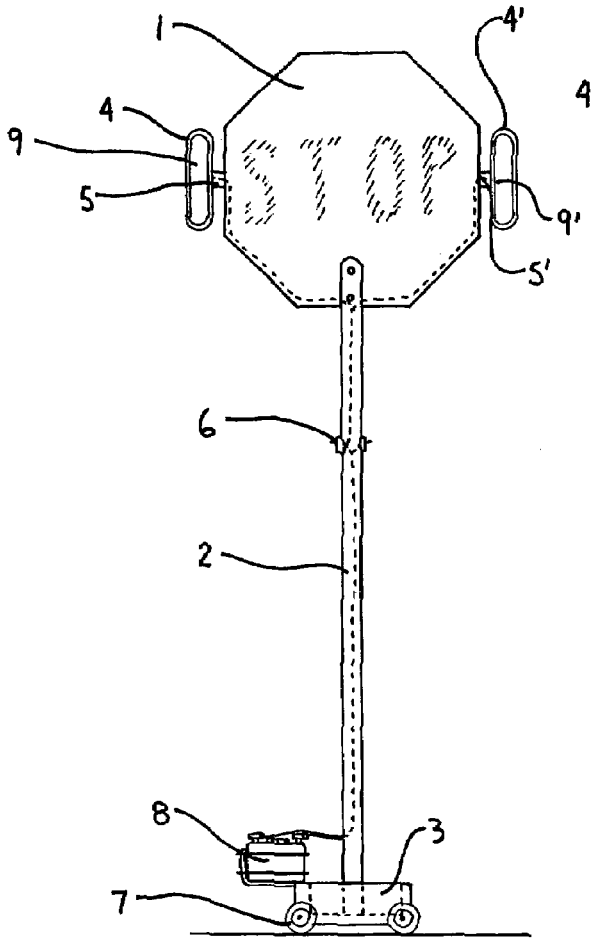
FIG. 1 is a front view of the four-wheeled embodiment of the reversible sign, showing the "stop" side of the sign.

Attached to opposite upper vertical sides of sign of the reversible highway traffic sign 1 are left 4 and right 4' light boxes 4. These light boxes are large enough to accommodate front red (STOP) and back yellow (SLOW) lights. A typical dimension for a light box is 9 inches high, 4 inches wide and 3 inches in depth. Each light box is attached to an opposite vertical edge of the sign 1 by left 5 and right 5' light box brackets. The brackets 5 and 5' may be bolted to the sign 1, or may have a detachable mechanism such as clips or clamps to attach the light boxes to the vertical sides of the sign as best shown in FIG. 1. This detaching means makes the entire apparatus adaptable to existing reversible highway traffic signs.

Located on the handle 2 of the device is a multi-functioned switch 6. Preferably, the wiring for the device between the red and yellow lights, the switch, and the lower power source, is run through the hollow handle 2 of the device. Standard reversible highway traffic signs are made of two inch PVC hollow pipe. The sign herein may be manufactured as a complete unit or discreet parts of this device such as the light boxes, brackets, wiring, switch and power source may be retro-fitted to existing highway safety signs. The two-inch hollow pipe of the standard highway safety sign is sufficient to accommodate the wiring of the device so that the wiring is internal to the structure itself. It has been found that wiring on the outside of the sign is cumbersome and can, in of itself, be dangerous. If the wires are not enclosed, the highway flagmen must also attend to the wiring in addition to the actual direction of the traffic at the construction sight.

The bottom of the handle 2 rests on a base 3', which in the preferred embodiment comprises a two-wheeled dolly with a horizontal lower platform 11 to support the power source 8. The base may also have four wheels as shown in FIG. 1. The base (3 or 3') has two or more wheels 7 for easy transportation and reversal of the sign. The wheels may be placed on swivels. While the workmen will normally simply twist the sign 180 degrees when such a reversal maneuver is required, by utilizing this device the workman is also able to move the base 3', and hence the entire sign, due to the presence of the swivel wheels 7.

Also attached, or riding on, the base 3' is a power source 8, which, in the preferred embodiment, comprises a twelve-volt DC battery. The battery supplies the electromotive force to the lights. The battery is rechargeable utilizing an AC current outlet. Another embodiment of this device would include solar charging panels that charge the battery or provide the electromotive source to the lights directly.

Figure 3:
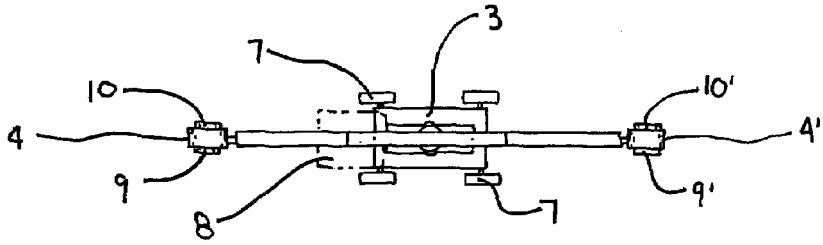
FIG. 3 is a top view of the sign shown in FIG. 1.

The most important feature of this particular device are the left 9 and right 9' red lights and the left 10 and right 10' yellow lights. These red and yellow lights are located on opposite sides of the corresponding left 4 and right 4' light boxes, as best shown in FIG. 3. Viewing the front or "stop" side of the sign one would see the letters "STOP" and the left 9 and right 9' red lights. Viewing the back or "slow" side of the sign, one would see the letters "SLOW" and the left 10 and right 10' yellow lights. The dimensions of the left and right light boxes 4 and 4' are such that the placement of left and right red and yellow lights, respectively, can be accommodated.

Figure 4:
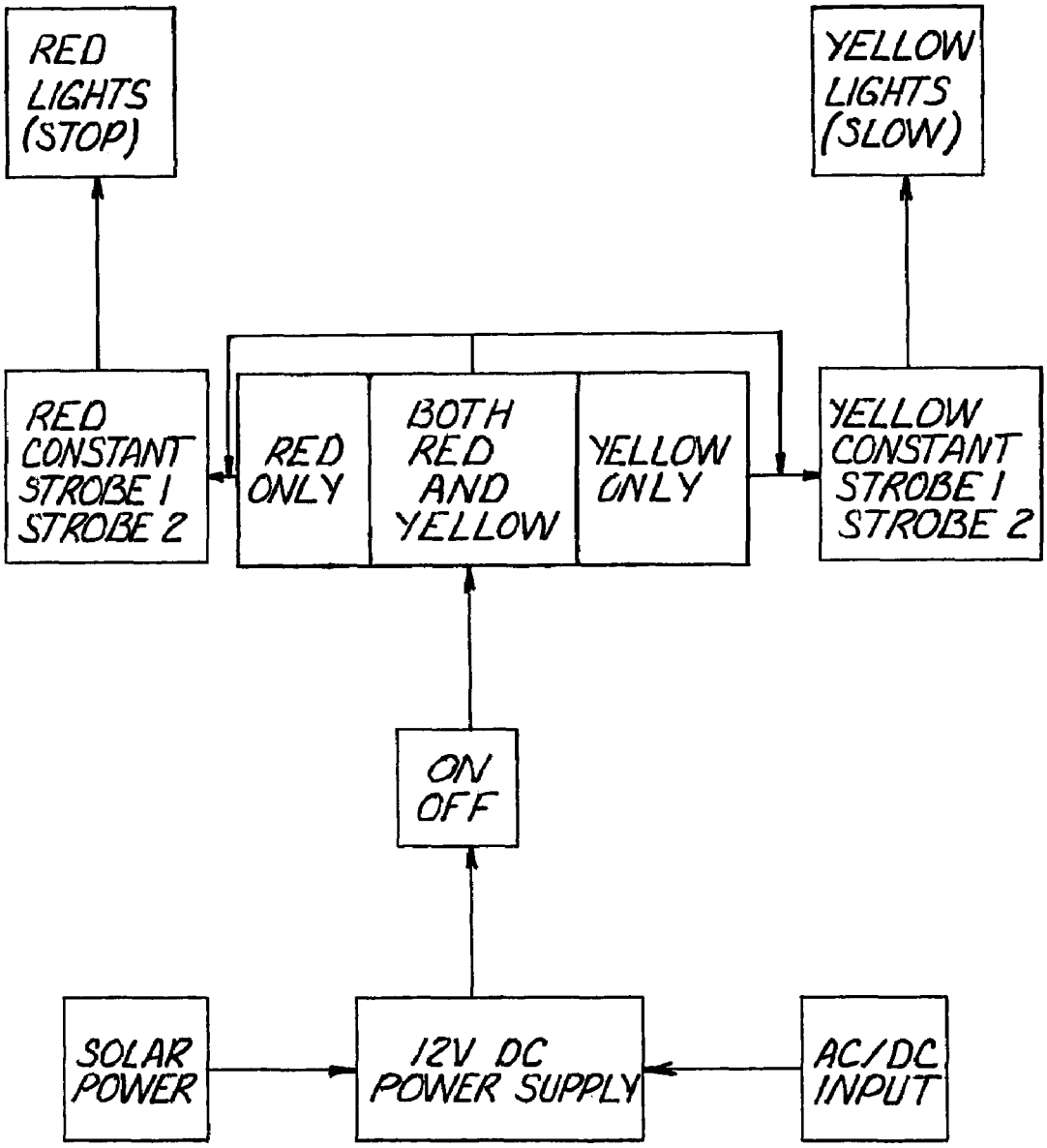
FIG. 4 is a block diagram of the electrical system of the reversible sign.

Turning now to the block diagram shown in FIG. 4, the wiring system and special features are shown. Electromotive force, commonly a twelve-volt DC power supply (but alternatively an AC input or solar power input) feeds the electricity to the switch. The switch is capable of switching the red and yellow lights both ON, either ON or both completely OFF, or it may switch the lights in selected patterns as described below. When either the red or yellow lights or both are turned ON, they may function in various different modes.

Utilizing the multi-functioned switch 6, either the red lights or the yellow lights, or both may be turned ON in a steady illumination. Alternatively, only the red or yellow lights may be turned ON.

Each of the red and yellow lights may be switched through different modes independently. Each may be in the constant mode, or each may strobe slowly (strobe 1 position) or each may strobe rapidly (strobe 2 position). The lights may also be configured to blink. In addition, the red and yellow lights operate independently, so that many combinations of illumination of the red, yellow, or both lights may be selected as desired. For example, the red light may show a constant red while the opposite yellow lights may strobe either slowly or rapidly. Alternatively, the yellow lights may be ON constantly while the red lights strobe slowly or rapidly. As can be seen from the diagram, many different combinations of the hazard illumination lighting features can be selected.

The above-described specification is meant as a means of illustration only and not as a limitation. The lighting pattern in particular can be varied to many different lighting patterns. For example, it may be desired to have the red lights or the yellow lights blink at a constant pace rather than strobe. Many different lighting modes may be utilized and such varied lighting modes are well within the contemplation of the present invention.

In practice it has been found that the unique modes of illuminating the lights, as well as the presence of red lights on the "stop" side of the sign and yellow lights on the "slow" of the sign provides the most effective means of illumination and attention to the hazard for any highway safety device yet developed. Since this device is readily attachable to already existing highway signs, the cost of converting existing signs with no lights to a highly illuminated warning signs with many modes of attracting the drivers' attention is provided.

Having fully described my device, I claim:

1. An illumination apparatus for a STOP/SLOW reversible highway safety sign, said sign having opposite vertical sides and opposite STOP and SLOW sides, comprising:

1. a pair of left and right light boxes detachably connected to opposite vertical sides of a reversible highway safety sign;
2. left and right red lights located respectively in the left and right light boxes on the front STOP side of said sign electrically connected to a wiring system connectable to a power source and including a switch selectably operable for controlling the red lights to operate in different modes, including a first strobe mode wherein the red lights are strobed at a first speed, a second strobe mode wherein the red lights are strobed at a second speed faster than the first speed, and a steady ON mode;
3. left and right yellow lights located respectively in the left and right lightboxes on the back SLOW side of the sign electrically connected to a wiring system connectable to a power source and including a switch selectably operable for controlling the yellow lights independently of the red lights to operate in different modes, including a first strobe mode wherein the yellow lights are strobed at a first speed, a second strobe mode wherein the yellow lights are strobed at a second speed faster than the first speed, and a steady ON mode; and
4. a hollow vertical pole below and supporting said sign and said lights.

2. An illumination apparatus for a STOP/SLOW reversible highway safety sign, having opposite vertical sides and opposite STOP and SLOW sides, as in claim 1, wherein said wiring system is connected to a power source which comprises a 12-volt rechargeable battery.

3. An illumination apparatus for a STOP/SLOW reversible highway safety sign, having opposite vertical sides and opposite STOP and SLOW sides, as in claim 1, further comprising a base in connection with said pole and having wheels for moving said apparatus.

4. An illumination apparatus for a STOP/SLOW reversible highway safety sign, having opposite vertical sides and opposite STOP and SLOW sides, as in claim 1, wherein said wiring systems are located inside of said pole.

5. An illumination apparatus for a STOP/SLOW reversible highway safety sign, having opposite vertical sides and opposite STOP and SLOW sides, as in claim 1, wherein said lights may be switched into a "blink" mode.

* * * * *